US011295668B2

(12) United States Patent
Hu et al.

(10) Patent No.: US 11,295,668 B2
(45) Date of Patent: Apr. 5, 2022

(54) PIXEL CIRCUIT, DISPLAY PANEL, DISPLAY DEVICE AND PIXEL DRIVING METHOD

(71) Applicants: Hefei BOE Display Technology Co., Ltd., Anhui (CN); BOE TECHNOLOGY GROUP CO., LTD., Beijing (CN)

(72) Inventors: Zuquan Hu, Beijing (CN); Peng Jiang, Beijing (CN); Ke Dai, Beijing (CN)

(73) Assignees: Hefei BOE Display Technology Co., Ltd., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/052,558

(22) PCT Filed: Mar. 3, 2020

(86) PCT No.: PCT/CN2020/077571
§ 371 (c)(1),
(2) Date: Nov. 3, 2020

(87) PCT Pub. No.: WO2020/182017
PCT Pub. Date: Sep. 17, 2020

(65) Prior Publication Data

US 2021/0183310 A1 Jun. 17, 2021

(30) Foreign Application Priority Data

Mar. 11, 2019 (CN) ..... 201910180239.4

(51) Int. Cl.
*G09G 3/3233* (2016.01)

(52) U.S. Cl.
CPC ... *G09G 3/3233* (2013.01); *G09G 2300/0426* (2013.01); *G09G 2300/0819* (2013.01);
(Continued)

(58) Field of Classification Search
CPC ..... G09G 3/3233; G09G 2300/0819; G09G 2300/0842; G09G 2330/02; G09G 2320/0233; G09G 2300/0426
See application file for complete search history.

(56) References Cited

U.S. PATENT DOCUMENTS 7,956,825 B2 6/2011 Kane
2013/0328852 A1 12/2013 Bae et al.
(Continued)

FOREIGN PATENT DOCUMENTS

CN 1932943 A 3/2007
CN 101251982 A 8/2008
(Continued)

OTHER PUBLICATIONS

China Patent Office, First Office Action dated Mar. 24, 2020 regarding CN201910180239.4 and the English translation thereof.
(Continued)

*Primary Examiner* — Jeff Piziali
(74) *Attorney, Agent, or Firm* — Houtteman Law LLC

(57) ABSTRACT

Provided are a pixel circuit, a display panel, a display device and a pixel driving method, the pixel circuit including: a data compensation circuit, a storage circuit, a driving transistor and a replication transistor, the replication transistor and the driving transistor have the same structure; the data compensation circuit writes, in an initialization stage, a first voltage into a first node under a control of a second control signal and a third control signal; and to write, in a data writing and compensation stage, under a control of the third control signal and a first control signal, a data voltage to a first electrode of the replication transistor to detect a threshold voltage thereof, write a compensation voltage to the first node for storage by the storage circuit, the compensation
(Continued)

voltage being equal to a sum of the data voltage and the threshold voltage of the replication transistor.

9 Claims, 3 Drawing Sheets

(52) U.S. Cl.
CPC ..... *G09G 2300/0842* (2013.01); *G09G 2320/0233* (2013.01); *G09G 2330/02* (2013.01)

(56) References Cited

U.S. PATENT DOCUMENTS

| | | | | |
|---|---|---|---|---|
| 2015/0243215 | A1 | 8/2015 | Kim et al. | |
| 2016/0204166 | A1* | 7/2016 | Yang | G06F 3/044 345/173 |
| 2017/0193904 | A1* | 7/2017 | Xu | G09G 3/3258 |
| 2018/0061318 | A1* | 3/2018 | Yin | H05B 33/14 |
| 2019/0237017 | A1* | 8/2019 | Xiang | G09G 3/3241 |

FOREIGN PATENT DOCUMENTS

| | | | |
|---|---|---|---|
| CN | 100424742 | C | 10/2008 |
| CN | 101765876 | A | 6/2010 |
| CN | 102290027 | A | 12/2011 |
| CN | 102542977 | A | 7/2012 |
| CN | 103218970 | A | 7/2013 |
| CN | 104464612 | A | 3/2015 |
| CN | 104575395 | A | 4/2015 |
| CN | 104637446 | A | 5/2015 |
| CN | 107886897 | A | 4/2018 |
| CN | 107993683 | A | 5/2018 |
| CN | 108806605 | A | 11/2018 |
| CN | 109256088 | A | 1/2019 |
| CN | 109448639 | A | 3/2019 |
| CN | 109767724 | A | 5/2019 |
| KR | 20070002891 | A | 1/2007 |

OTHER PUBLICATIONS

China Patent Office, Second Office Action dated Sep. 10, 2020 regarding CN201910180239.4 and the English translation thereof.
China Patent Office, third Office Action dated Jan. 18, 2021 regarding CN201910180239.4 and the English translation thereof.

* cited by examiner

--Prior Art--

--Prior Art--

PIXEL CIRCUIT, DISPLAY PANEL, DISPLAY DEVICE AND PIXEL DRIVING METHOD

CROSS REFERENCE TO RELATED APPLICATION

The present application is a U.S. National Stage Application under 35 U.S.C. § 371 of International Patent Application PCT/CN2020/077571, filed on Mar. 3, 2020, which claims priority to China Patent Application No. 201910180239.4, filed on Mar. 11, 2019, the disclosure of both which are incorporated by reference here in entirety.

TECHNICAL FIELD

The present disclosure relates to the field of display technology, and in particular, to a pixel circuit, a display panel, a display device, and a pixel driving method.

BACKGROUND

An Organic Light-Emitting Diode (OLED) can emit light when being driven by a current generated by a driving transistor in a saturated state, and when a same gray scale voltage is input, different threshold voltages may result in different driving currents, which causes inconsistency of the driving currents.

SUMMARY

An embodiment of the present disclosure provides a pixel circuit, including: a data compensation circuit, a storage circuit, a driving transistor and a replication transistor, the replication transistor and the driving transistor have a same structure;

a gate of the replication transistor, a gate of the driving transistor, the data compensation circuit and the storage circuit are coupled to a first node, a first electrode of the replication transistor and a second electrode of the replication transistor are both coupled to the data compensation circuit, a first electrode of the driving transistor is coupled to a first electrode of a light emitting device, and a second electrode of the driving transistor is coupled to a second power supply terminal;

the data compensation circuit is coupled to a first power supply terminal, a data line, a first control signal line, a second control signal line and a third control signal line, and is configured to write, in an initialization stage, a first voltage provided by the first power supply terminal into the first node in response to a control of a second control signal provided by the second control signal line and a third control signal provided by the third control signal line; and to write, in a data writing and compensation stage, in response to a control of the third control signal and a first control signal provided by the first control signal line, a data voltage provided by the data line to the first electrode of the replication transistor to detect a threshold voltage of the replication transistor, and write a compensation voltage to the first node for storage by the storage circuit, the compensation voltage being equal to a sum of the data voltage and the threshold voltage of the replication transistor;

the storage circuit is further coupled to the second power supply terminal and configured to provide the compensation voltage to the first node in a light emitting stage;

the driving transistor is configured to output a corresponding driving current according to the compensation voltage during the light emitting stage to drive the light emitting device to emit light.

In some implementations, the data compensation circuit includes: a data writing sub-circuit and an initialization and compensation sub-circuit;

the data writing sub-circuit is coupled to the first control signal line and configured to write, in the data writing and compensation stage, the data voltage into the first electrode of the replication transistor in response to a control of the first control signal;

the initialization and compensation sub-circuit is coupled to the second control signal line and the third control signal line and configured to write, in the initialization stage, the first voltage into the first node in response to the control of the second control signal and the third control signal so as to initialize the first node; and to write, in the data writing and compensation stage, in response to the control of the third control signal, the compensation voltage to the first node according to a signal output from the second electrode of the replication transistor.

In some implementations, the data writing sub-circuit includes a first transistor;

a control electrode of the first transistor is coupled to the first control signal line, a first electrode of the first transistor is coupled to the data line, and a second electrode of the first transistor is coupled to the first electrode of the replication transistor.

In some implementations, the initialization and compensation sub-circuit includes a second transistor and a third transistor;

a control electrode of the second transistor is coupled to the second control signal line, a first electrode of the second transistor is coupled to the first power supply terminal, and a second electrode of the second transistor is coupled to the second electrode of the replication transistor;

a control electrode of the third transistor is coupled to the third control signal line, a first electrode of the third transistor is coupled to the second electrode of the replication transistor, and a second electrode of the third transistor is coupled to the first node.

In some implementations, the storage circuit includes a storage capacitor;

a first terminal of the storage capacitor is coupled to the first node, and a second terminal of the storage capacitor is coupled to the second power supply terminal.

In some implementations, the pixel circuit further includes: a light emitting control circuit coupled to the first electrode of the driving transistor;

the light emitting control circuit is coupled to a fourth control signal line and configured to enable, in the light emitting stage, in response to a control of a fourth control signal provided by the fourth control signal line, the driving current output by the driving transistor to flow through the light emitting device; and disables, in other stages, the current output by the driving transistor to flow through the light emitting device.

In some implementations, the light emitting control circuit includes a fourth transistor;

a control electrode of the fourth transistor is coupled to the fourth control signal line, a first electrode of the fourth transistor is coupled to the first power supply terminal, and a second electrode of the fourth transistor is coupled to the first electrode of the driving transistor;

the fourth control signal line and the third control signal line are a same control signal line.

In some implementations, the gate of the replication transistor is disposed in a same layer as the gate of the driving transistor;

the first electrode of the replication transistor, the second electrode of the replication transistor, the first electrode of the driving transistor and the second electrode of the driving transistor are arranged in a same layer;

an active layer of the replication transistor is disposed at a same layer as an active layer of the driving transistor.

In some implementations, all transistors in the pixel circuit are N-type transistors simultaneously or P-type transistors simultaneously.

An embodiment of the present disclosure provides a display panel, including the pixel circuit described above.

An embodiment of the present disclosure provides a display device, including the display panel described above.

An embodiment of the present disclosure provides a pixel driving method, which is based on the pixel circuit described above, the pixel driving method including:

in the initialization stage, the data compensation circuit writes the first voltage to the first node in response to the control of the second control signal and the third control signal;

in the data writing and compensation stage, the data compensation circuit writes, in response to the control of the first control signal and the third control signal, the data voltage into the first electrode of the replication transistor to detect the threshold voltage of the replication transistor, and writes the compensation voltage into the first node for storage by the storage circuit;

in the light emitting stage, the storage circuit provides the compensation voltage to the first node, and the driving transistor outputs the corresponding driving current according to the compensation voltage to drive the light emitting device to emit light.

DESCRIPTION OF EMBODIMENTS

In order to make those skilled in the art better understand the technical solutions of the present disclosure, a pixel circuit, a display panel, a display device, and a pixel driving method provided by the present disclosure will be described in detail below with reference to the accompanying drawings.

In the related art, the 2T1C pixel circuit always has poor brightness uniformity, and in order to solve this problem, an effective solution is to add a compensation circuit in a pixel, and eliminate influence of a threshold voltage of a driving transistor on a driving current through the compensation circuit. At present, the compensation principle of a pixel circuit with a threshold compensation function is as follows: firstly, the threshold voltage of the driving transistor is acquired by using the compensation circuit, and the threshold voltage is written into a storage capacitor; then, a data voltage is written into a terminal of the storage capacitor, so that a voltage at the other terminal (which is coupled with a gate electrode of the driving transistor) of the storage capacitor is pulled up due to bootstrap effect of the storage capacitor, to obtain a compensation voltage; finally, the compensation voltage is used for controlling the driving transistor to output the driving current so as to perform threshold compensation on the driving transistor.

However, in practical applications, it is found that when the other terminal of the storage capacitor is pulled up to the compensation voltage based on the bootstrap effect of the storage capacitor, the storage capacitor and a parasitic capacitor of the driving transistor are coupled in series, so that the compensation voltage obtained through the bootstrap effect of the storage capacitor is affected by the storage capacitor and the parasitic capacitor of the driving transistor, and the compensation voltage actually obtained deviates from an ideal compensation voltage, which results in that a precise compensation cannot be performed.

Figure 1:
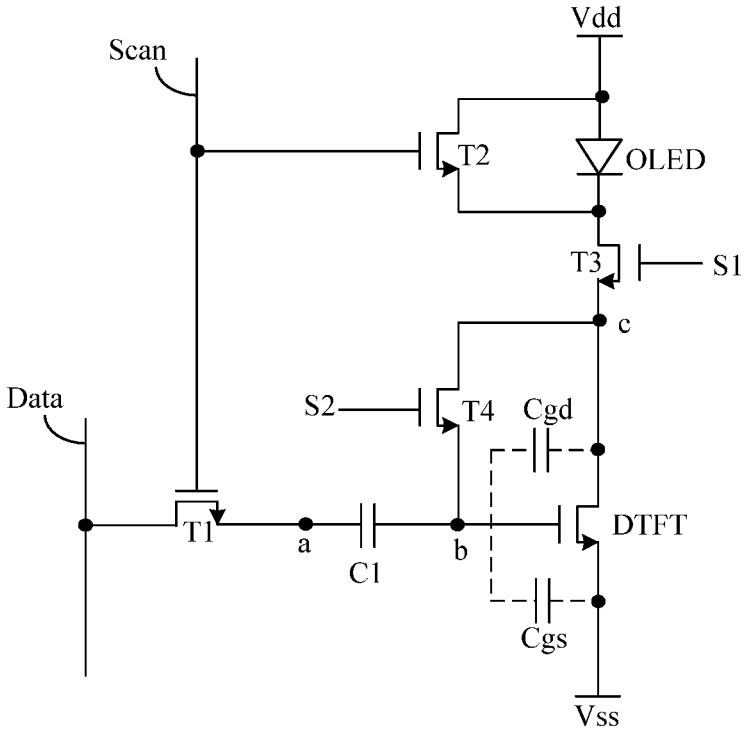
FIG. 1 is a schematic circuit diagram of a pixel circuit provided in the related art.
Figure 2:
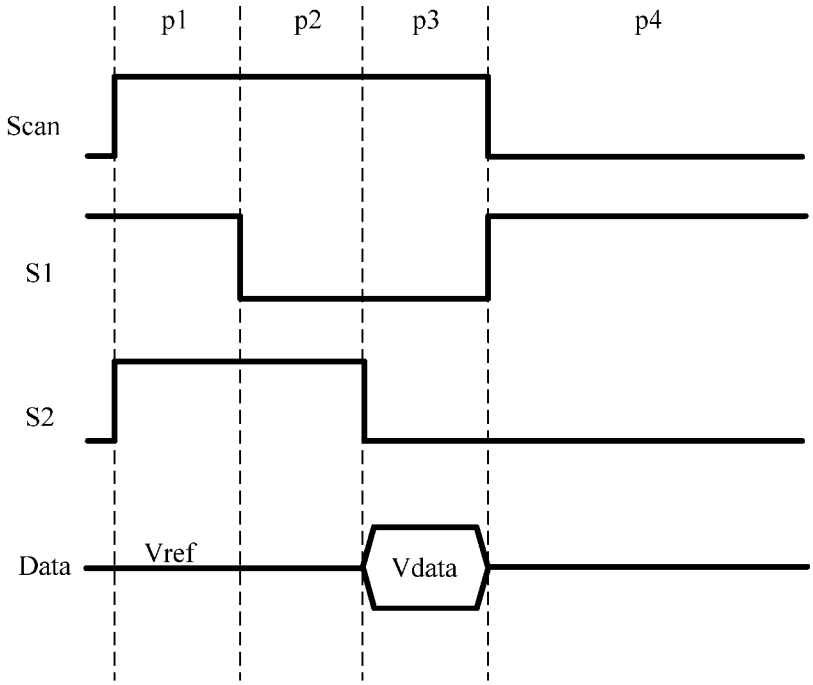
FIG. 2 is a timing diagram illustrating operations of the pixel circuit shown in FIG. 1.

FIG. 1 is a schematic circuit diagram of a pixel circuit in the related art, and FIG. 2 is a timing diagram of an operation of the pixel circuit shown in FIG. 1. The following will be illustrated with reference to FIGS. 1 and 2 and by taking all transistors shown in FIG. 1 being N-type transistors at the same time as an example.

The operation of the pixel circuit shown in FIG. 1 includes the following four stages p1 to p4.

In the first stage p1, a scanning signal line Scan provides a high level signal, a control signal line S1 provides a high level signal, a control signal line S2 provides a high level signal, and a data line Data provides a reference voltage Vref; at this time, transistors T1, T2, T3, and T4 are all turned on, the reference voltage Vref is written to a node a through the transistor T1, a first voltage Vdd is written to a node c through the transistor T2 and the transistor T3, and is then written to a node b through the transistor T4. At this time, a voltage of the node a is Vref, and voltages of the nodes b and c are Vdd.

In the second stage p2, the scanning signal line Scan provides a high level signal, the control signal line S1 provides a low level signal, the control signal line S2 provides a high level signal, and the data line Data provides the reference voltage Vref. At this time, the transistor T3 is turned off, and Vdd is no longer charged to the node b and the node c, and the node b and the node c are discharged through the driving transistor DTFT, a voltage between the two nodes starts to drop, and when the voltage between the node b and the node c drops to Vss+Vth, the driving transistor DTFT is turned off. At this time, the voltage of the node a maintains Vref, and a voltage difference across both terminals of the storage capacitor C1 (the voltage difference between the node a and the node b) is Vref-Vss-Vth, where Vth is the threshold voltage of the driving transistor DTFT.

In the third stage p3, the scanning signal line Scan provides a high level signal, the control signal line S1 provides a low level signal, the control signal line S2 provides a low level signal, and the data line Data provides a data voltage Vdata. At this time, the transistors T1 and T2 are turned on, and the transistors S3 and S4 are turned off. Since the transistor T4 is turned off, the node b is in a floating state. When the data line writes the data voltage Vdata to the node a through the transistor T1, the storage capacitor C1 maintains a voltage difference across both terminals thereof constant by bootstrap effect, and the voltage of the node b jumps to Vss+Vth+Vdata-Vref without considering parasitic capacitances Cgd and Cgs of the driving transistor DTFT.

In the fourth stage p4, the scanning signal line Scan provides a low level signal, the control signal line S1 provides a high level signal, the control signal line S2 provides a low level signal, and the data line Data provides the reference voltage Vref, and thus the transistors T, T2, and T4 are turned off and the transistor T3 is turned on.

At this time, a gate-source voltage Vgs of the driving transistor DTFT is equal to Vth+Vdata-Vref, and it can be obtained according to a formula of saturated driving current of the driving transistor DTFT that:

$$\begin{aligned} I &= K*(Vgs-Vth)^2 \\ &= K*(Vth+Vdata-Vref-Vth)^2 \\ &= K*(Vdata-Vref)^2, \end{aligned}$$

where I is the driving current output by the driving transistor DTFT, and K is a constant. As can be seen from the above formula, the driving current output by the driving transistor is related to the data voltage Vdata and the reference voltage Vref, and is not related to the threshold voltage of the driving transistor DTFT, thereby implementing a threshold compensation.

However, in an actual compensation process, in the third stage p3, when the data line Data writes the data voltage into the node a, the voltage at the node b may rise due to the bootstrap effect of the storage capacitor C1, but since the parasitic capacitances Cgd and Cgs of the driving transistor are coupled in series with the storage capacitor C1, the parasitic capacitances Cgd and Cgs may have a voltage division effect, so that the voltage Vb at the node b can only rise to $$\frac{(Vss+Vth+Vdata-Vref)*C1+(Vss+Vth)*(Cgd+Cgs)}{C1+Cgd+Cgs},$$

therefore, in the fourth stage p4, the gate-source voltage Vgs of the driving transistor DTFT is equal to Vb-Vss, that is, $$Vgs=\frac{(Vth+Vdata-Vref)*C1+Vth*(Cgd+Cgs)}{C1+Cgd+Cgs},$$

it can be obtained according to the formula of saturated driving current formula of the driving transistor DTFT that:

$$\begin{aligned} I &= K*(Vgs-Vth)^2 \\ &= K*\left[\frac{(Vth+Vdata-Vref)*C1+Vth*(Cgd+Cgs)}{C1+Cgd+Cgs}-Vth\right]^2 \\ &= K*\left[\frac{(Vdata-Vref)*C1}{C1+Cgd+Cgs}\right]^2. \end{aligned}$$

At this time, as can be seen from the above formula, the driving current output from the driving transistor DTFT is related to the storage capacitor C1, the parasitic capacitors Cgd and Cgs, although it is not related to the threshold voltage of the driving transistor.

Therefore, when storage capacitors C1 and parasitic capacitors Cgd and Cgs in different pixel regions of the display panel are different due to process variations, even if a same data voltage Vdata and a same reference voltage Vref are provided, driving transistors in different pixel regions still generate different driving currents, that is, the conventional pixel circuit cannot perform a precise compensation.

In order to solve the above technical problems in the related art, the present disclosure provides a pixel circuit capable of accurately compensating for a threshold voltage of the driving transistor.

It should be noted that the light emitting device in the present disclosure may be a current-driven light emitting device including an LED (Light Emitting Diode) or an OLED (Organic Light Emitting Diode) in the related art, and the following embodiments are described by taking the light emitting device being an OLED as an example.

In addition, the transistors in the present disclosure may be thin film transistors or field effect transistors or other switching devices having similar characteristics. A Transistor generally includes three electrodes: a gate, a source and a drain, the source and the drain of the transistor are symmetrical in structure and they are interchangeable as required. In the present disclosure, the control electrode refers to the gate of the transistor, and one of the first electrode and the second electrode is the source and the other one of the first electrode and the second electrode is the drain.

Figure 3:
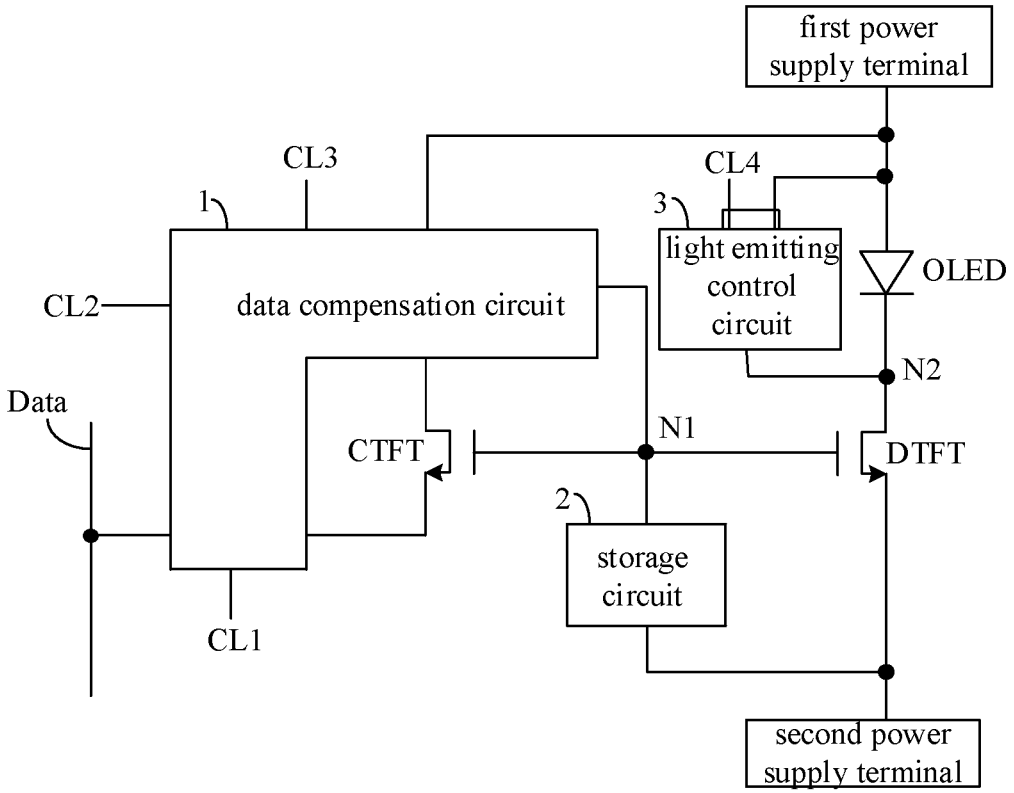
FIG. 3 is a schematic circuit diagram of a pixel circuit according to an embodiment of the present disclosure.

FIG. 3 is a schematic circuit diagram of a pixel circuit according to an embodiment of the present disclosure. As shown in FIG. 3, the pixel circuit includes: a data compensation circuit 1, a storage circuit 2, a driving transistor DTFT, and a replication transistor CTFT that has the same structure as the driving transistor DTFT.

A gate of the replication transistor CTFT, a gate of the driving transistor DTFT, the data compensation circuit 1, and the storage circuit 2 are coupled to a first node N1, a first electrode of the replication transistor CTFT and a second electrode of the replication transistor CTFT are both coupled to the data compensation circuit 1, a first electrode of the driving transistor DTFT is coupled to a first electrode of the light emitting device OLED, a second electrode of the light emitting device OLED is coupled to a first power supply terminal, and a second electrode of the driving transistor DTFT is coupled to a second power supply terminal.

The data compensation circuit 1 is coupled with the first power supply terminal, a data line Data, a first control signal line CL1, a second control signal line CL2 and a third control signal line CL3, and the data compensation circuit 1 is configured to write a first voltage provided by the first power supply terminal into the first node N1 in response to a control of a second control signal provided by the second control signal line CL2 and a third control signal provided by the third control signal line CL3 in an initialization stage; and in an data writing and compensation stage, in response to a control of the third control signal and a first control signal provided by the first control signal line CL1, write a data voltage provided by the data line Data into the first electrode of the replication transistor CTFT to detect a threshold voltage of the replication transistor CTFT, and write a compensation voltage into the first node N1 for storage by the storage circuit 2, where the compensation voltage is equal to a sum of the data voltage and the threshold voltage of the replication transistor CTFT.

The storage circuit 2 is coupled to the second power supply terminal, and the storage circuit 2 is configured to supply the compensation voltage to the first node N1 during a light emitting stage.

The driving transistor DTFT is configured to output a corresponding driving current according to the compensation voltage during the light emitting stage, so as to drive the light emitting device OLED to emit light.

In the embodiment of the present disclosure, the fact that the replication transistor CTFT and the driving transistor DTFT have the same structure means that shapes, sizes and materials used for the two transistors are substantially the same, so as to ensure that threshold voltages of the two transistors are the same when the two transistors are completely manufactured. As an implementation, the replication transistor CTFT and the driving transistor DTFT may be manufactured by a single manufacturing process and at the same time, so as to ensure that the structures thereof are the same. In addition, during subsequent use, the gate of the replication transistor CTFT is coupled to the gate of the driving transistor DTFT, and the gate of the replication transistor CTFT and the gate of the driving transistor DTFT are located at a short distance (in a single pixel), so that drift amounts of threshold voltages of the replication transistor CTFT and the driving transistor DTFT are the same at a certain same time, that is, the threshold voltages of the replication transistor CTFT and the driving transistor DTFT are the same at any time.

In an actual production process, the replication transistor CTFT and the driving transistor DTFT in a single pixel circuit are close to each other, so that, in a manufacturing process, it is easy to realize that the structures of the replication transistor CTFT and the driving transistor DTFT are identical. In addition, in order to ensure that the drift amounts of the threshold voltages of the replication transistor CTFT and the driving transistor DTFT are always the same during use, the replication transistor CTFT and the driving transistor DTFT may be located as close as possible.

In some implementations, the gate of the replication transistor CTFT is disposed in a same layer as the gate of the driving transistor DTFT; the first electrode of the replication transistor CTFT, the second electrode of the replication transistor CTFT, the first electrode of the driving transistor DTFT and the second electrode of the driving transistor DTFT are arranged in a same layer; an active layer of the replication transistor CTFT is disposed in a same layer as an active layer of the driving transistor DTFT. Namely, a same manufacturing process may be adopted to simultaneously manufacture the replication transistor CTFT and the driving transistor DTFT, in this way, the process error in the manufacturing process can be reduced as much as possible, so as to ensure that, although that the replication transistor CTFT and the driving transistor DTFT manufactured are at different positions, the replication transistor CTFT and the driving transistor DTFT are completely the same in structure.

It should be noted that "disposed in a same layer" in the present disclosure means being located in a same functional film layer structure; different structures arranged in a same layer may be manufactured by a same material, and thus can be simultaneously manufactured by adopting a single patterning process; distances between different structures arranged in a same layer and a base substrate may be the same or different.

In the embodiments of the present disclosure, the first power supply terminal provides a first voltage Vdd, and the second power supply terminal provides a second voltage Vss.

The operation of the pixel circuit shown in FIG. 3 includes an initialization stage, a data writing and compensation stage, and a light emitting stage.

In the initialization stage, the data compensation circuit 1 writes the first voltage to the first node N1 in response to the control of the second control signal and the third control signal to perform a reset process on the voltage at the first node N1.

In the data writing and compensation stage, the data line Data supplies a data voltage Vdata to the data compensation circuit 1, and the data compensation circuit 1 writes, in response to the control of the first control signal and the third control signal, the data voltage Vdata to the first electrode of the replication transistor CTFT to detect the threshold voltage Vth-CTFT of the replication transistor CTFT and writes a compensation voltage to the first node N1 for storage by the storage circuit 2.

Unlike in the related art, in the present embodiment, the threshold voltage $Vth_{_CTFT}$ of the replication transistor CTFT is detected based on the data voltage, and a compensation voltage having a magnitude equal to a sum of the data voltage Vdata and the threshold voltage $Vth_{_CTFT}$ of the replication transistor CTFT is written to the first node N1 for storage by the storage circuit 2. In the process of writing the compensation voltage to the first node N1, even if the driving transistor DTFT itself has parasitic capacitances Cgd and Cgs, the parasitic capacitances Cgd and Cgs do not affect the writing process of the compensation voltage, so that the compensation voltage can be accurately written to the first node N1.

In the light emitting stage, the storage circuit 2 provides the compensation voltage to the first node N1, and the driving transistor DTFT outputs a corresponding driving current according to the compensation voltage to drive the light emitting device OLED to emit light.

At this time, the gate-source voltage Vgs of the driving transistor DTFT is equal to $Vdata+Vth_{_CTFT}-Vss$, and it can be obtained according to the formula of saturated driving current of the driving transistor DTFT that:

$$\begin{aligned} I &= K*(Vgs - Vth_{_DTFT})^2 \\ &= K*(Vdata + Vth_{_CTFT} - Vss - Vth_{_DTFT})^2, \end{aligned}$$

where, $Vth_{_DTFT}$ is the threshold voltage of the driving transistor DTFT, it can be seen from the foregoing analysis, $Vth_{_DTFT}=Vth_{_CTFT}$; thus, the driving current $I=K*(Vdata-Vss)^2$.

As can be seen from the above formula, the driving current output by the driving transistor DTFT is related to the data voltage Vdata and is not related to the threshold voltage $Vth_{_DTFT}$ of the driving transistor DTFT, thereby implementing threshold compensation of the driving transistor DTFT.

Based on the above description, it can be seen that the technical solution of the present disclosure can implement accurate writing of the compensation voltage having a magnitude equal to the sum of the data voltage Vdata and the threshold voltage $Vth_{_CTFT}$ of the replication transistor CTFT into the first node N1, and control the light emitting device to emit light according to the compensation voltage in the light emitting stage, thereby implementing accurate compensation on the threshold voltage of the driving transistor DTFT.

In some implementations, the pixel circuit further includes: a light emitting control circuit 3, the light emitting control circuit 3 is coupled to the first electrode of the driving transistor DTFT; the light emitting control circuit 3 is further coupled to a fourth control signal line CL4 for enabling the driving current output from the driving transistor DTFT to flow through the light emitting device OLED in response to a control of a fourth control signal supplied from the fourth control signal line CL4 during the light emitting stage; and disabling, in other stages, the current outputted from the driving transistor DTFT to flow through the light emitting device OLED.

In the present disclosure, by providing the light emitting control circuit 3 to control the flow direction of the current output by the driving transistor DTFT, the light emitting device OLED can be prevented from emitting light by mistake at any stage other than the light emitting stage.

It should be noted that, the case where the light emitting control circuit 3 and the light emitting device OLED are coupled in parallel as shown in the drawings is only for illustrative purposes, and does not limit the technical solution of the present disclosure. In the present disclosure, the light emitting control circuit 3 may also be disposed between the first electrode of the driving transistor DTFT and the first electrode of the light emitting device OLED, and detailed description of which may be referred to the following.

Figure 4:
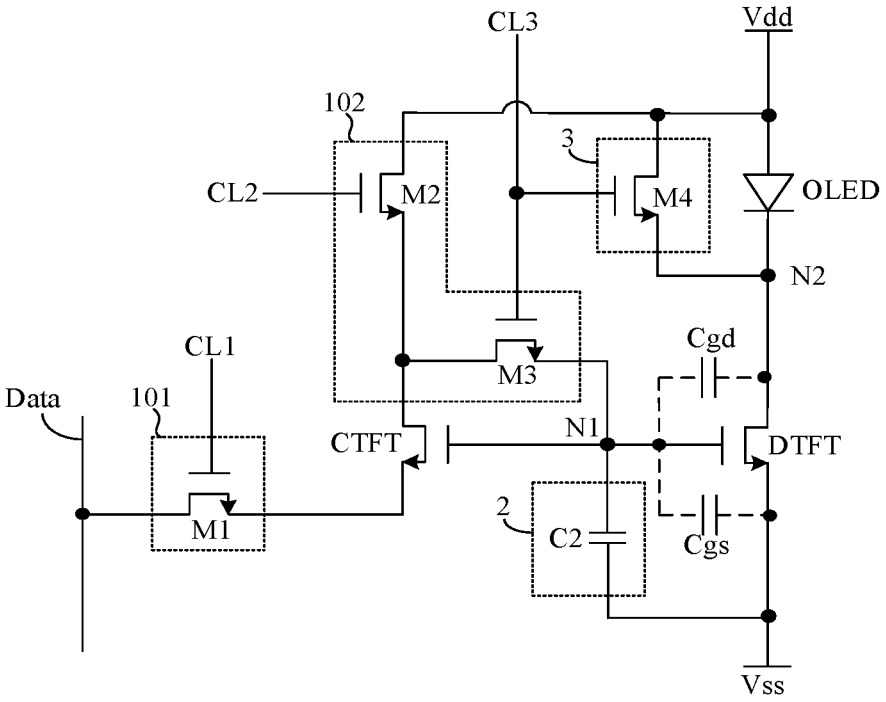
FIG. 4 is another schematic circuit diagram of a pixel circuit according to an embodiment of the present disclosure.

FIG. 4 is another schematic circuit structure diagram of a pixel circuit provided in an embodiment of the present disclosure, and as shown in FIG. 4, the pixel circuit shown in FIG. 4 is an embodiment based on the pixel circuit shown in FIG. 3.

In the present embodiment, the data compensation circuit 1 includes: a data writing sub-circuit 101 and an initialization and compensation sub-circuit 102.

The data writing sub-circuit 101 is coupled to the first control signal line CL1, and the data writing sub-circuit 101 is configured to write the data voltage to the first electrode of the replication transistor CTFT in response to the control of the first control signal during the data writing and compensation stage.

The initialization and compensation sub-circuit 102 is coupled to the second control signal line CL2 and the third control signal line CL3, and the initialization and compensation sub-circuit 102 is configured to write a first voltage to the first node N1 in response to the control of the second control signal and the third control signal during an initialization stage, so as to initialize the first node N1; and to write the compensation voltage to the first node N1 according to a signal output from the second electrode of the replication transistor CTFT in response to the control of the third control signal during the data writing and compensation stage.

In some implementations, the data writing sub-circuit 101 includes: a first transistor T1, a control electrode of the first transistor T1 is coupled to the first control signal line CL1, a first electrode of the first transistor T1 is coupled to the data line Data, and a second electrode of the first transistor T1 is coupled to the first electrode of the replication transistor CTFT.

In some implementations, the initialization and compensation sub-circuit 102 includes: a second transistor T2 and a third transistor T3; a control electrode of the second transistor T2 is coupled to the second control signal line CL2, a first electrode of the second transistor T2 is coupled to the first power supply terminal, and a second electrode of the second transistor T2 is coupled to the second electrode of the replication transistor CTFT; a control electrode of the third transistor T3 is coupled to the third control signal line CL3, a first electrode of the third transistor T3 is coupled to the second electrode of the replication transistor CTFT, and a second electrode of the third transistor T3 is coupled to the first node N1.

In some implementations, the storage circuit 2 includes: a storage capacitor C2; a first terminal of the storage capacitor C2 is coupled to the first node N1, and a second terminal of the storage capacitor C2 is coupled to the second power supply terminal.

In some implementations, the light emitting control circuit 3 includes: a fourth transistor T4; a control electrode of the fourth transistor T4 is coupled to the fourth control signal line, a first electrode of the fourth transistor T4 is coupled to the first power supply terminal, a second electrode of the fourth transistor T4 is coupled to the first electrode of the driving transistor DTFT, and the fourth control signal line and the third control signal line CL3 are a same control signal line (which are collectively referred to as the third control signal line CL 3).

Transistors can be classified into N-type transistors and P-type transistors according to characteristics thereof; when the transistor is an N-type transistor, a voltage for turning on the transistor is a high level voltage, and a voltage for turning off the transistor is a low level voltage; when the transistor is a P-type transistor, a voltage for turning on the transistor is a low level voltage and a voltage for turning off the transistor is a high level voltage. In the following description, all transistors in the pixel circuit are exemplified as N-type transistors at the same time, so as to facilitate understanding of those skilled in the art. The first power supply terminal provides the first voltage Vdd, and the second power supply terminal provides the second voltage Vss (Vss is about 0V).

Figure 5:
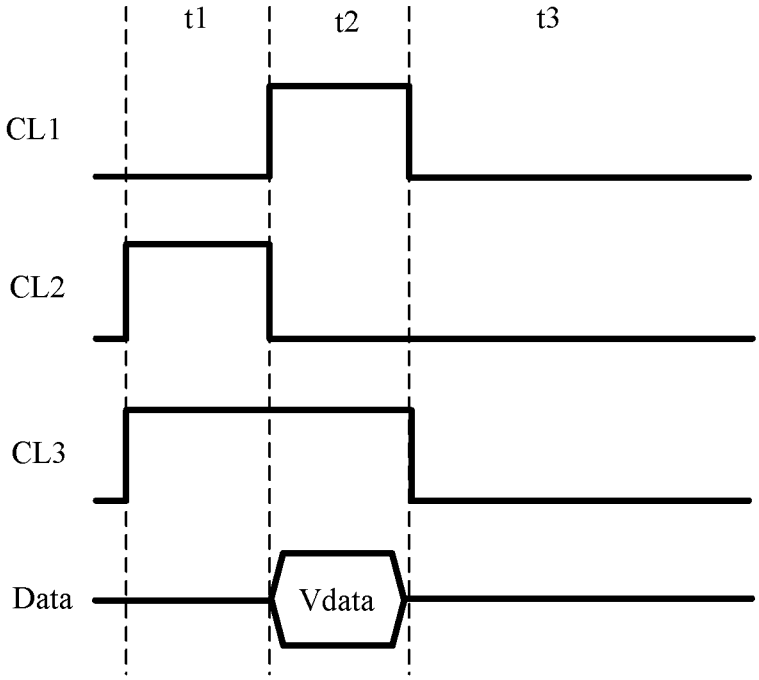
FIG. 5 is a timing diagram illustrating operations of the pixel circuit shown in FIG. 4.

FIG. 5 is a timing diagram illustrating an operation of the pixel circuit shown in FIG. 4, and as shown in FIG. 5, the operation of the pixel circuit includes three stages: an initialization stage, a data writing and compensation stage and a light emitting stage.

In the initialization stage t1, the first control signal provided by the first control signal line CL1 is at a low level, the second control signal provided by the second control signal line CL2 is at a high level, and the third control signal provided by the third control signal line CL3 is at a high level. At this time, the second transistor M2, the third transistor M3, and the fourth transistor M4 are all turned on, and the first transistor M1 is turned off.

Since the second transistor T2 and the third transistor T3 are turned on, the first voltage Vdd can be written to the first node N1 through the second transistor M2 and the third transistor M3, and both voltages of the first node N1 and the second node N2 are Vdd.

It should be noted that, although the driving transistor DTFT is turned on and outputs a current, since the fourth transistor M4 is turned on (the light emitting device OLED is short-circuited), the current output from the driving transistor DTFT flows to the first power supply terminal through the fourth transistor M4, and does not flow through the light emitting device OLED, so that the driving transistor DTFT does not emit light by mistake.

In the data writing and compensation stage t2, the first control signal provided by the first control signal line CL1 is at a high level, the second control signal provided by the second control signal line CL2 is at a low level, the third control signal provided by the third control signal line CL3 is at a high level, and the data line Data provides the data voltage Vdata; at this time, the first transistor M1, the third transistor M3, and the fourth transistor M4 are all turned on, and the second transistor M2 is turned off.

Since the voltage at the first node N1 is Vdd at the end of the initialization stage t1, the replication transistor CTFT is turned on at the initial time of the data writing and compensation stage. Since the first transistor M1 is turned on, the third transistor M3 is turned on, and the second transistor M2 is turned off, a path is formed between the first node N1 and the data line Data through the third transistor M3, the replication transistor CTFT, and the first transistor M1, the first node N1 can discharge through the path, and the voltage at the first node N1 starts to drop; when the voltage at the first node N1 drops to Vdata+Vth$_{_CTFT}$, the replication transistor CTFT is turned off, and the discharge ends. The discharging process is not affected by the parasitic capacitances Cgd and Cgs of the driving transistor DTFT.

The process of the voltage at the first node N1 dropping from Vdd to Vdata+Vth$_{_CTFT}$ can be regarded as a process in which the initialization and compensation sub-circuit 102 detects the threshold voltage Vth$_{_CTFT}$ of the replication transistor CTFT according to the signal output from the second electrode of the replication transistor CTFT, and the compensation voltage Vdata+Vth$_{_CTFT}$ is accurately written to the first node N1.

At this time, a voltage difference across the two terminals of the storage capacitor C2 is Vdata+Vth$_{_CTFT}$−Vss, that is, the storage capacitor C2 completes storing the compensation voltage.

In the light emitting stage t3, the first control signal provided by the first control signal line CL1 is at a low level, the second control signal provided by the second control signal line CL2 is at a low level, and the third control signal provided by the third control signal line CL3 is at a low level; at this time, the first transistor M1, the second transistor M2, the third transistor M3, and the fourth transistor M4 are all turned off.

At this time, the storage capacitor C2 maintains the voltage at the first node N1 at Vdata+Vth$_{_CTFT}$, i.e., the storage capacitor C2 provides the compensation voltage to the first node N1.

At this time, the gate-source voltage Vgs of the driving transistor DTFT is equal to Vdata+Vth$_{_CTFT}$-Vss, thus it can be obtained according to the formula of saturated driving current of the driving transistor DTFT that:

$$\begin{aligned} I &= K*(Vgs - Vth_{_DTFT})^2 \\ &= K*(Vdata + Vth_{_CTFT} - Vss - Vth_{_DTFT})^2 \\ &= K*(Vdata - Vss)^2. \end{aligned}$$

As can be seen from the above formula, the driving current output by the driving transistor DTFT is related to the data voltage Vdata and is not related to the threshold voltage of the driving transistor DTFT, thereby implementing a threshold compensation on the driving transistor DTFT.

It should be noted that, the case where the control electrode of the fourth transistor M4 is coupled to the fourth control signal line, the first electrode of the fourth transistor M4 is coupled to the first power supply terminal, the second electrode of the fourth transistor M4 is coupled to the first electrode of the driving transistor DTFT, and the fourth control signal line and the third control signal line CL3 are the same control signal line is an embodiment of the present disclosure, and it can reduce types of control signal lines required to be arranged in the pixel circuit and reduce a complexity of a driving control process.

In the present disclosure, the fourth transistor M4 may also be disposed between the first electrode of the driving transistor DTFT and the first electrode of the light emitting device OLED (this case is not shown in drawings). Specifically, the first electrode of the fourth transistor M4 may be coupled to the first electrode of the light emitting device OLED, the second electrode of the fourth transistor M4 may be coupled to the first electrode of the driving transistor DTFT, the fourth control signal line coupled to the control electrode of the fourth transistor M4 is a control signal line different from the first control signal line CL1 to the third control signal line CL3, at this time, the fourth transistor M4 is controlled by the fourth control signal provided by the fourth control signal line, the fourth transistor M4 is turned on only in the light emitting stage to transmit the driving current output by the driving transistor DTFT to the light emitting device OLED, and the fourth transistor M4 is turned off in the initialization stage and the data writing and compensation stage to decouple the first electrode of the driving transistor DTFT from the first electrode of the light emitting device OLED, thereby preventing the light emitting device OLED from emitting light by mistake.

In addition, the case where all the transistors in the pixel circuit are N-type transistors at the same time is an embodiment in the present disclosure, and all the transistors in the pixel circuit can be simultaneously manufactured by using a single manufacturing process, so that the manufacturing cycle can be shortened. Certainly, in the present disclosure, all transistors in the pixel circuit may also be P-type transistors at the same time, and at this time, all the transistors may also be simultaneously manufactured by using a single manufacturing process.

It should be noted that, each transistor in the present disclosure may be independently selected from N-type transistors or P-type transistors, and the state of each transistor is controlled by configuring a corresponding control signal according to the type of the transistor to implement the operation process as described above, which also falls into the protection scope of the present disclosure.

Figure 6:
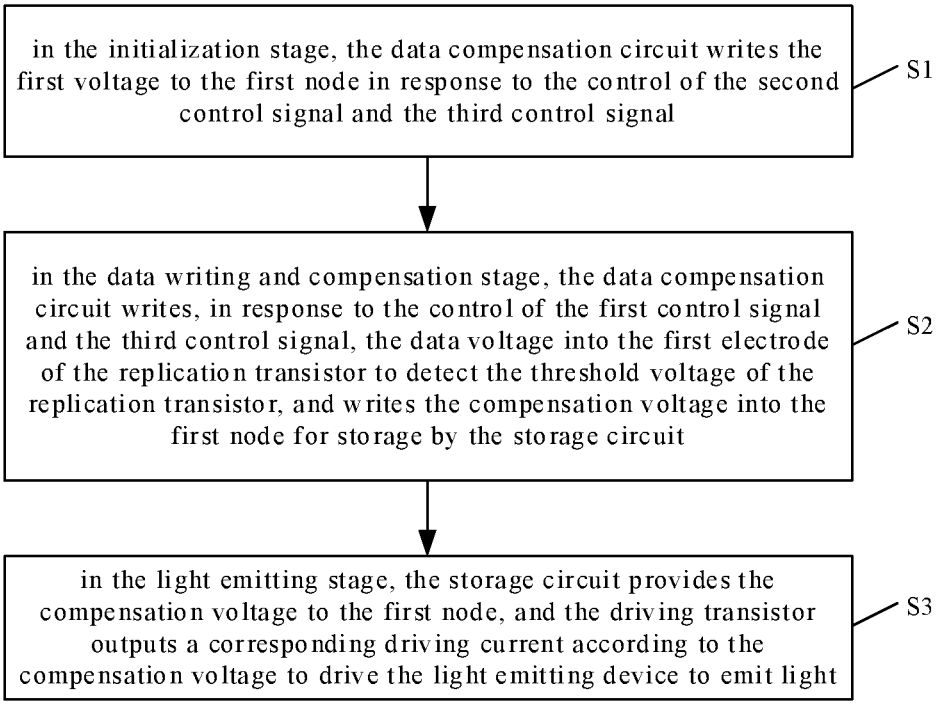
FIG. 6 is a flowchart of a pixel driving method according to an embodiment of the present disclosure.

FIG. 6 is a flowchart of a pixel driving method provided in an embodiment of the present disclosure, and as shown in FIG. 6, the pixel driving method is based on the pixel circuit provided in the foregoing embodiment, and the pixel driving method includes:

Step S1, in the initialization stage, the data compensation circuit writes the first voltage into the first node in response to the control of the second control signal and the third control signal;

Step S2, in the data writing and compensation stage, the data compensation circuit writes, in response to the control of the first control signal and the third control signal, the data voltage into the first electrode of the replication transistor to detect the threshold voltage of the replication transistor, and writes the compensation voltage into the first node for storage by the storage circuit; and Step S3, in the light emitting stage, the storage circuit provides the compensation voltage to the first node, and the driving transistor outputs a corresponding driving current according to the compensation voltage to drive the light emitting device to emit light.

For the detailed description of the steps S1 to S3, reference may be made to the corresponding contents in the foregoing embodiments, and details are not repeated herein.

The technical solutions of the present disclosure can realize that the compensation voltage having the magnitude equal to the sum of the data voltage and the threshold voltage of the replication transistor is accurately written into the first node, the writing process is not influenced by the parasitic capacitances of the driving transistor, the light emitting device is controlled to emit light according to the compensation voltage in the light emitting stage, and the threshold voltage of the driving transistor can be accurately compensated.

An embodiment of the present disclosure further provides a display panel, including: a pixel circuit provided by the foregoing embodiment.

An embodiment of the present disclosure further provides a display device, including: a display panel provided by the foregoing embodiment.

It should be noted that, the display device in the present disclosure may specifically include any product or component with a display function, such as electronic paper, an OLED panel, a mobile phone, a tablet computer, a television, a display, a notebook computer, a digital photo frame and a navigator.

It should be understood that the above embodiments are merely exemplary embodiments adopted to illustrate the principle of the present disclosure, and the present disclosure is not limited thereto. It will be apparent to those skilled in the art that various modifications and improvements may be made without departing from the spirit and scope of the present disclosure, and such modifications and improvements are considered to be within the scope of the present disclosure.

The invention claimed is:

1. A pixel circuit, comprising: a data compensation circuit, a storage circuit, a driving transistor and a replication transistor, the replication transistor and the driving transistor have a same structure;

a gate of the replication transistor, a gate of the driving transistor, the data compensation circuit and the storage circuit are coupled to a first node, a first electrode of the replication transistor and a second electrode of the replication transistor are both coupled to the data compensation circuit, a first electrode of the driving transistor is coupled to a first electrode of a light emitting device, and a second electrode of the driving transistor is coupled to a second power supply terminal;

the data compensation circuit is coupled to a first power supply terminal, a data line, a first control signal line, a second control signal line and a third control signal line, and is configured to write, in an initialization stage, a first voltage provided by the first power supply terminal into the first node in response to a control of a second control signal provided by the second control signal line and a third control signal provided by the third control signal line; and to write, in a data writing and compensation stage, a data voltage provided by the data line to the first electrode of the replication transistor in response to a control of the third control signal and a first control signal provided by the first control signal line to detect a threshold voltage of the replication transistor, and write a compensation voltage to the first node for storage by the storage circuit, the compensation voltage being equal to a sum of the data voltage and the threshold voltage of the replication transistor;

the storage circuit is further coupled to the second power supply terminal and configured to provide the compensation voltage to the first node in a light emitting stage;

the driving transistor is configured to output a corresponding driving current according to the compensation voltage during the light emitting stage to drive the light emitting device to emit light, wherein the data compensation circuit comprises: a data writing sub-circuit and an initialization and compensation sub-circuit;

the data writing sub-circuit is coupled to the first control signal line and configured to write, in the data writing and compensation stage, the data voltage into the first electrode of the replication transistor in response to the control of the first control signal;

the initialization and compensation sub-circuit is coupled to the second control signal line and the third control signal line and configured to write, in the initialization stage, the first voltage into the first node in response to the control of the second control signal and the third control signal so as to initialize the first node; and to write, in the data writing and compensation stage, in response to the control of the third control signal, the compensation voltage to the first node according to a signal output from the second electrode of the replication transistor, wherein the data writing sub-circuit comprises a first transistor, a control electrode of the first transistor is coupled to the first control signal line, a first electrode of the first transistor is coupled to the data line, and a second electrode of the first transistor is coupled to the first electrode of the replication transistor, wherein the initialization and compensation sub-circuit comprises a second transistor and a third transistor; a control electrode of the second transistor is coupled to the second control signal line, a first electrode of the second transistor is coupled to the first power supply terminal, and a second electrode of the second transistor is coupled to the second electrode of the replication transistor; a control electrode of the third transistor is coupled to the third control signal line, a first electrode of the third transistor is coupled to the second electrode of the replication transistor, and a second electrode of the third transistor is coupled to the first node, wherein the storage circuit comprises a storage capacitor; a first terminal of the storage capacitor is coupled to the first node, and a second terminal of the storage capacitor is coupled to the second power supply terminal, the pixel circuit further comprises: a light emitting control circuit coupled to the first electrode of the driving transistor; the light emitting control circuit is coupled to a fourth control signal line and configured to enable, in response to a control of a fourth control signal provided by the fourth control signal line, in the light emitting stage, the driving current output by the driving transistor to flow through the light emitting device; and disable, in other stages, the current output by the driving transistor to flow through the light emitting device, and wherein the light emitting control circuit comprises a fourth transistor; a control electrode of the fourth transistor is coupled to the fourth control signal line, a first electrode of the fourth transistor is coupled to the first power supply terminal, and a second electrode of the fourth transistor is coupled to the first electrode of the driving transistor; the fourth control signal line and the third control signal line are a same control signal line.

2. The pixel circuit of claim 1, wherein the gate of the replication transistor is disposed in a same layer as the gate of the driving transistor;

the first electrode of the replication transistor, the second electrode of the replication transistor, the first electrode of the driving transistor and the second electrode of the driving transistor are arranged in a same layer;

an active layer of the replication transistor is disposed at a same layer as an active layer of the driving transistor.

3. A pixel circuit of claim 1, wherein all transistors in the pixel circuit are N-type transistors or P-type transistors simultaneously.

4. A display panel, comprising: a pixel circuit of claim 1.

5. A display device, comprising: a display panel of claim 4.

6. A pixel driving method based on the pixel circuit of claim 1, the pixel driving method comprising:

in the initialization stage, the data compensation circuit writes the first voltage to the first node in response to the control of the second control signal and the third control signal;

in the data writing and compensation stage, the data compensation circuit writes, in response to the control of the first control signal and the third control signal, the data voltage into the first electrode of the replication transistor to detect the threshold voltage of the replication transistor, and writes the compensation voltage into the first node for storage by the storage circuit;

in the light emitting stage, the storage circuit provides the compensation voltage to the first node, and the driving transistor outputs a corresponding driving current according to the compensation voltage to drive the light emitting device to emit light.

7. A display panel, comprising: a pixel circuit of claim 2.

8. A display device, comprising: a display panel of claim 7.

9. A pixel driving method based on the pixel circuit of claim 2, the pixel driving method comprising:

in the initialization stage, the data compensation circuit writes the first voltage to the first node in response to the control of the second control signal and the third control signal;

in the data writing and compensation stage, the data compensation circuit writes, in response to the control of the first control signal and the third control signal, the data voltage into the first electrode of the replication transistor to detect the threshold voltage of the replication transistor, and writes the compensation voltage into the first node for storage by the storage circuit;

in the light emitting stage, the storage circuit provides the compensation voltage to the first node, and the driving transistor outputs a corresponding driving current according to the compensation voltage to drive the light emitting device to emit light.

* * * * *